US006616729B2

(12) United States Patent
Motegi et al.

(10) Patent No.: US 6,616,729 B2
(45) Date of Patent: Sep. 9, 2003

(54) METHOD OF GRAIN REFINING CAST MAGNESIUM ALLOY

(75) Inventors: Tetsuichi Motegi, 6-41-25-105 Futawahigashi, Funabashi-shi, Chiba (JP); Kiichi Miyazaki, 2272-7 Kaminote, Tamamura-machi, Sawa-gun, Gunma (JP); Yoshitomo Tezuka, Hachiouji (JP); Kiyotaka Yoshihara, 2-15-2 Higashichuo, Fukushima-shi, Fukushima (JP); Eiji Yano, Narashino (JP)

(73) Assignees: Tetsuichi Motegi, Funabashi (JP); part interest; Kiichi Miyazaki, Sawa-gun (JP); part interest; Yoshitoma Tezuka, Hachiouji (JP); part interest; Kiyotaka Yoshihara, Fukushima (JP); part interest; Seiko Idea Center Co., Ltd., Tokyo (JP); part interest ( * ) Notice: Subject to any disclaimer, the term of this patent is extended or adjusted under 35 U.S.C. 154(b) by 0 days.

(21) Appl. No.: 10/207,208

(22) Filed: Jul. 30, 2002

(65) Prior Publication Data

US 2003/0019547 A1 Jan. 30, 2003

(30) Foreign Application Priority Data

Jul. 30, 2001 (JP) ..... 2001-230142

(51) Int. Cl.[7] ..... C22C 23/00

(52) U.S. Cl. ..... 75/604; 75/603; 75/600; 148/538; 148/420; 420/410; 420/409

(58) Field of Search ..... 75/603, 604; 148/538, 148/420; 420/410, 409

(56) References Cited

U.S. PATENT DOCUMENTS 2,448,993 A * 9/1948 Mahoney et al. ..... 420/407
3,144,323 A * 8/1964 Watson et al. ..... 75/604

FOREIGN PATENT DOCUMENTS

EP 575796 A1 * 12/1993 ..... C22C/1/03

OTHER PUBLICATIONS

R. Kumar, et al., Grain Size Control of Magnesium, British Foundryman, Institute of British Foundryment, Chesterfield, GB, vol. 66, No. Part 2, Jan. 1973, pp. 39–42.

Database CA Online!, Chemical Abstracts Service, Columbus, Ohio, U.S., Tamura, Yousuke et al., Grain Refinement of Case Mg–Al Alloys, retrieved from STN Database Accession No. 129:178684 CA XP002223040.

* cited by examiner

*Primary Examiner*—Roy King
*Assistant Examiner*—Andrew Wessman
(74) *Attorney, Agent, or Firm*—Oblon, Spivak, McClelland, Maier & Neustadt, P.C.

(57) ABSTRACT

A method of grain refining cast magnesium alloy includes adding to a magnesium alloy melt containing aluminum and manganese, pure carbon powder, or a carbon source in combination with niobium pentoxide or vanadium pentoxide.

14 Claims, 12 Drawing Sheets

METHOD OF GRAIN REFINING CAST MAGNESIUM ALLOY

BACKGROUND OF THE INVENTION

1. Field of the Invention

The present invention relates to a method of refining the grains of the cast magnesium alloy without generating dioxin to improve the mechanical properties of the magnesium alloy.

2. Description of the Prior Art

Methods of grain refining magnesium alloy containing aluminum, such as AZ magnesium alloy, include methods that do not require a grain refiner and methods that require a grain refiner.

The former is a superheating method in which the casting melt is prepared by heating the alloy to around 150 to 250° C. (1123 to 1173 K) above the melting point, maintaining it at that temperature for 5 to 15 minutes (300 to 900 seconds), and then rapidly cooling it to the casting temperature. The grain refining mechanism is said to be heterogeneous nucleation by an Al—Mn—Fe compound. Because of the high process temperature, the energy costs of the method are high, and there is also the expense involved in preventing oxidation of the melt and in casting ladle checking and maintenance procedures. Thus, the method is beset by problems of economic feasibility and safety.

The latter includes a carbon addition method in which a carbon-containing compound is added to the melt at around 750° C. (1023 K). The grain refining mechanism is said to be heterogeneous nucleation by aluminum carbide ($Al_4C_3$) produced by carbon in the compound reacting with aluminum in the melt. In commercial processes $C_7Cl_6$ is used to be added as a grain refiner, but this is no longer allowed because it produces dioxins (2,3,7,8-tetrachlorodibenzo p-dioxin $Cl_2(C_6H_2)O_2(C_6H_2)Cl_2$).

There is also the ferric chloride method (Elfinal method) in which ferric chloride ($FeCl_3$) is added to a melt at around 760° C. (1053 K) and the melt is maintained for 30 to 60 minutes (1800 to 3600 seconds), giving rise to Al—Mn—Fe compound heterogeneous nuclei that are said to produce the grain refinement. It has been reported that in order to obtain a pronounced refinement effect, the Mn content has to be above a certain value. The problem with this method is corrosion produced by a localized battery effect of the Fe and My.

Compared to the superheating process, grain refinement by adding a grain refiner has the merits of a lower process temperature and suitability for large-volume melts. But, it also has the problem that it produces dioxin, generating a need for a refining agent that can be used instead of $C_2Cl_6$.

Also, in the case of the ferric chloride method, corrosion resistance is degraded by the battery effect, so there is a need to replace the $FeCl_3$ with a substance that alters the structure of the Al—Mn compound to effect grain refinement of castings without loss of corrosion resistance.

An object of the present invention is to provide a method of grain refining cast magnesium alloy to improve the mechanical properties of the alloy without producing dioxin or degrading the corrosion resistance.

SUMMARY OF THE INVENTION

To attain the above object, the present invention provides a method of grain refining cast magnesium alloy comprising adding, as a grain refiner, (i) pure carbon powder or (ii) a carbon source in combination with niobium pentoxide ($Nb_2O_5$) or vanadium pentoxide ($V_2O_5$) to a magnesium alloy melt containing aluminum and manganese.

By using a grain refiner thus comprised of carbon powder alone or a carbon source in combination with niobium pentoxide or vanadium pentoxide, it is possible to refine, without producing dioxin, the grain diameter of cast materials to 100 μm or smaller compared to grain diameters in the order of 140 to 200 μm when a refiner is not used, also improving the mechanical properties of the cast materials.

Particularly, in the case of addition of a carbon source in combination with niobium pentoxide or vanadium pentoxide, there can be obtained an effect of magnesium alloy refinement and an effect of shaping the Al—Mn compound into spheres.

Further features of the invention, its nature and various advantages will be more apparent from the accompanying drawings and following detailed description of the invention.

DESCRIPTION OF THE PREFERRED EMBODIMENT

Figure 1:
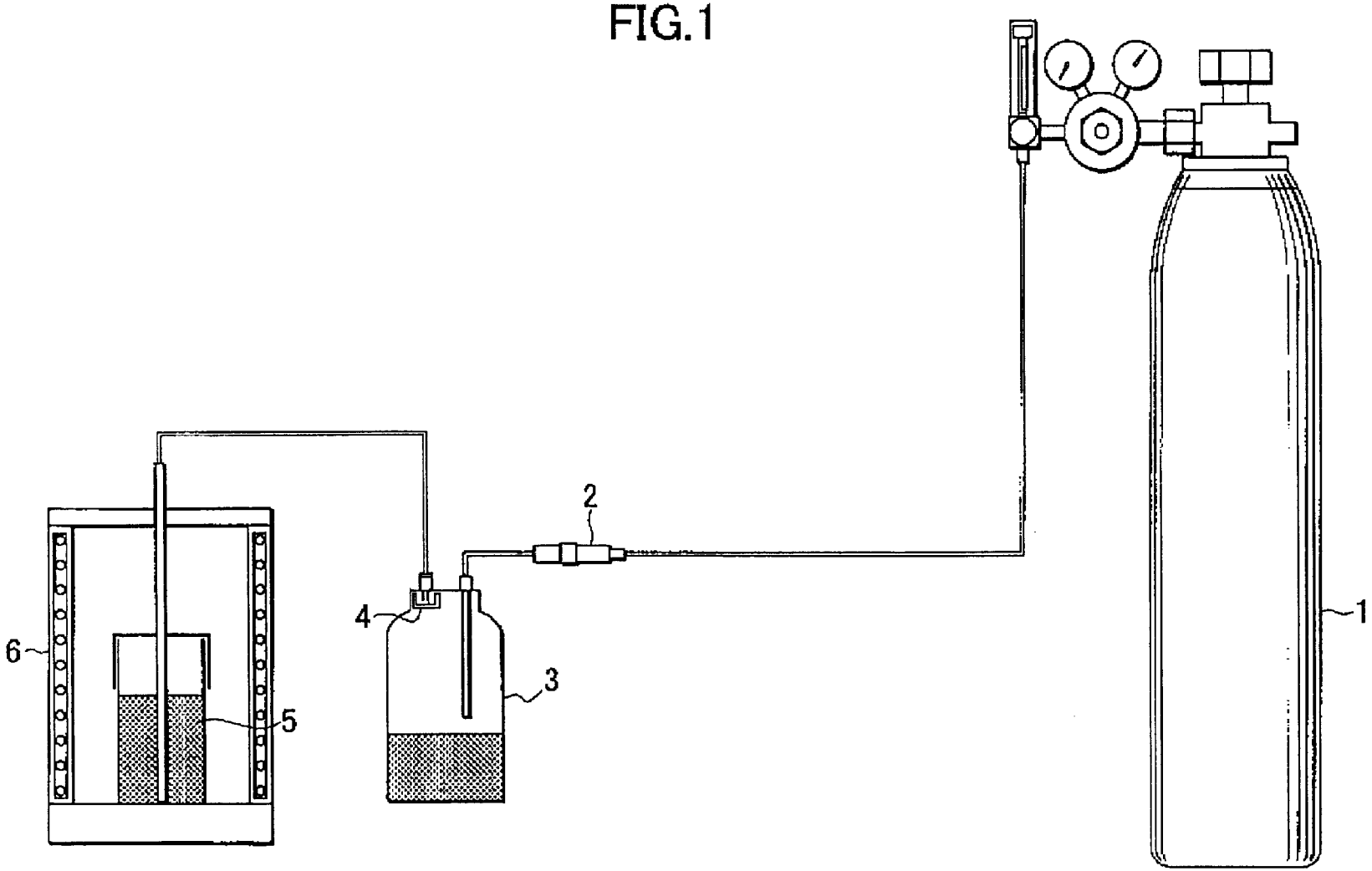
FIG. 1 illustrates an apparatus used in Example 1 of the present invention.

The present invention relates to a method of grain refining cast magnesium alloy comprising adding (i) pure carbon powder or (ii) a carbon source in combination with niobium pentoxide ($Nb_2O_5$) or vanadium pentoxide ($V_2O_5$) to a magnesium alloy melt containing aluminum and manganese. This addition can shape an Al—Mn compound into spheres and improve the mechanical strength of the cast magnesium alloy.

There is no particular limitation on the magnesium alloy containing aluminum and manganese, so long as it contains aluminum as a component and manganese as an impurity. For example, it is possible to use AZ91, which is also used for sand mold casting. Concerning the pure carbon powder used as a refining agent, in Example 1 described below, graphite with a particle size of up to 5 $\mu$m is used with a ultrahigh-purity argon (Ar) gas carrier, but this is not limitative. For example, helium (He) can be used as the carrier gas, and the finer the graphite is, the better the result. Also, activated carbon can be used on its own.

The amount of the pure carbon powder added as a refining agent that can exert the refinement effect is small as much as around 0.005 to 0.5% by weight based on the amount of the magnesium alloy melt.

The temperature of 993 K or higher at which the pure carbon powder is added to the molten Mg alloy will suffice. The more elevated above 1053 K the temperature is, the shorter the time it takes to achieve the refinement. However, since too high a temperature can result in ignition of the molten material, around 1023 K is preferable.

When a carbon source and $Nb_2O_5$ or $V_2O_5$ are used as the refiner, since it is assumed that the carbon source will be used in conjunction with the $Nb_2O_5$ or $V_2O_5$, it is not necessary to use the aforementioned pure carbon powder. Carbon dioxide ($CO_2$) gas or the like, or solid activated carbon can be used. When carbon dioxide ($CO_2$) gas is used an a carbon source, addition of sulfur hexafluoride ($SF_6$) gas or fleon 134a (HFC-134a) enhances the grain refinement effect. The $Nb_2O_5$ or $V_2O_5$ added with the carbon source can be added in powder form, or as tablets, pellets or other such aggregated forms. When activated carbon or the like is used as the carbon source, it too can be combined for addition in an aggregated form.

It is preferable to add the $Nb_2O_5$ or $V_2O_5$ in an amount that is 0.1 to 3% by weight based on the melt amount. If the added amount is less than 0.1% by weight, the grain refinement effect attained will not be sufficient. Thus, using a mixture of carbon dioxide ($CO_2$) gas with sulfur hexafluoride ($SF_6$) gas or fleon 134a (HFC-134a) or using activated carbon on its own will provide a sufficient grain refinement effect. Conversely if the added amount exceeds 3% by weight, the result is a higher impurity content without any additional refinement effect, degrading the mechanical properties of the cast product thus obtained.

It is preferable for the Mg alloy melt to be at a temperature of 993 to 1073 K, and more preferably 1033 to 1073 K, when the $Nb_2O_5$ or $V_2O_5$ is added. A relatively higher temperature increases the grain refinement effect. Grain refinement is not sufficient when the temperature is lower than 933 K. Also, when the temperature is higher than 1073 K, energy costs become high without any additional grain refinement. In particular, it was found that a high grain refinement effect was obtained at an adding temperature of 1073 K, regardless of the amount of $Nb_2O_5$ or $V_2O_5$ added; that is, high grain refinement was obtained even with the minimum 0.1 wt % addition.

As described above, in the case of addition of a carbon source in combination with $Nb_2O_5$ or $V_2O_5$, there can he obtained an effect of magnesium alloy refinement and an effect of shaping the Al—Mg compound into spheres.

When no grain-refining agent is used, the size of cast grains is around 140 to 200 $\mu$m. In accordance with the present invention, pronounced grain refinement was obtained. In the case of this invention, a cast grain size of 100 $\mu$m or smaller was set as a target signifying the attainment of a sufficient grain refinement effect. Moreover, cast products in which the grains were refined to 100 $\mu$m or smaller were also observed to contain spheroidized Al—Mn compounds diffused within the grains, which can be expected to improve the mechanical properties.

Thus, in accordance with the present invention, by using a grain refiner thus comprised of carbon powder alone or a carbon source in combination with niobium pentoxide or vanadium pentoxide, it is possible to refine the cast alloy grains to 100 $\mu$m or smaller, and improve the mechanical properties.

Examples of the present invention will now be described. However, it is to be understood that the invention is not limited to the examples described below.

EXAMPLE 1

A cylindrical melting pot was fabricated by bending and gas-welding Fe—Cr system SUS 430 stainless steel (Fe-18%Cr) plate not containing Ni. To increase the resistance to high-temperature oxidation, the melting pot was plated by immersion in a melt of pure aluminum, and superheat-diffused to form a surface layer of Mg and low-wettability $FeAl_3$. The melting pot and all casting utensils were coated with special reagent-grade magnesium oxide to prevent the admixture of impurities when the alloy is melted.

In this example, commercial AZ91E magnesium alloy was used, having the composition shown in Table 1 below, in which the unit is "mass %."

TABLE 1

| Al | Zn | Mn | Si | Cu | Ni | Fe | Mg |
|---|---|---|---|---|---|---|---|
| 9.01 | 0.82 | 0.22 | 0.01 | 0.001 | 0.0002 | 0.0017 | Bal. |

After pickling in nitric acid to remove impurities, the magnesium alloy ingots were placed in the melting pot and melted in an electric furnace. FIG. 1 shows the apparatus used, which comprises a cylinder 1 of ultrahigh-purity argon gas, a unit 2 for spraying carbon powder, a tank 3 of carbon powder having a particle size of 5 $\mu$m, a 200-mesh wire screen 4, the electric furnace 6, and the melting pot 5. Via the unit 2, gas from the cylinder 1 is supplied in pulses to the tank 3, blowing the carbon powder through the screen 4 and into the Mg alloy being melted in the melting pot 5 in the furnace 6.

700 grams of pickled alloy ingot was placed in the melting pot for melting. After melting, the alloy was maintained at 973 K while the argon gas intermittently blew the 5-$\mu$m carbon powder into the melt for 600 seconds. The alloy was then cast and an optical microscope was used to measure the average size of the cast grains. The same procedure was used to add 5-$\mu$m carbon powder to melts maintained at 993 K, 1013 K, 1053 K and 1073 K, respectively, and the average cast grain size in each case was measured.

For comparison, average grain sizes were measured in respect of alloy castings made after melting the alloy ingots, and alloy castings made after being subjected to a flow of just argon gas for 600 seconds.

Figure 2:
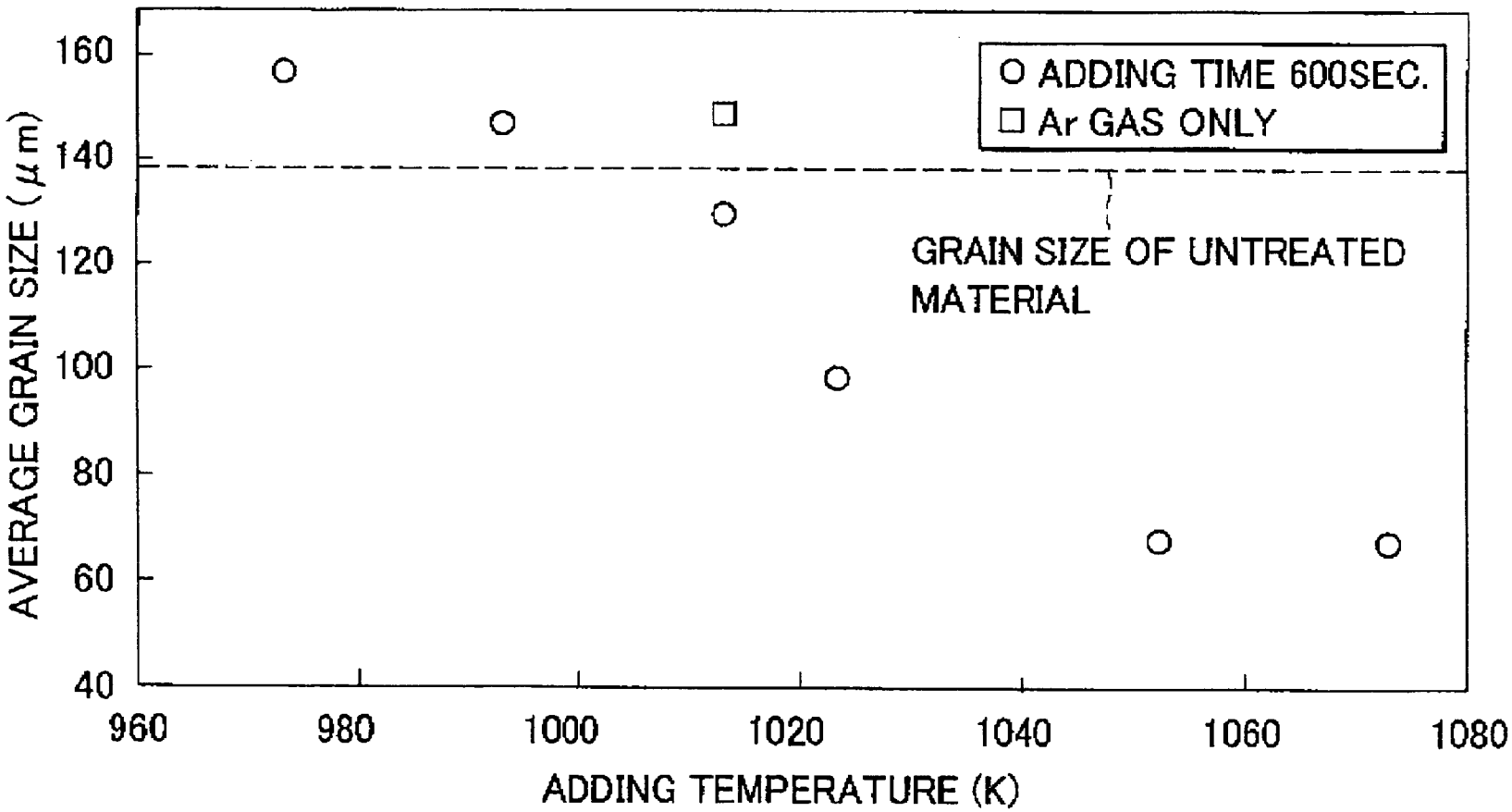
FIG. 2 is a graph showing the relationship in Example 1 between the temperature, at which 5-μm carbon powder is added, and the average grain size of the cast alloy structure.
Figure 3:
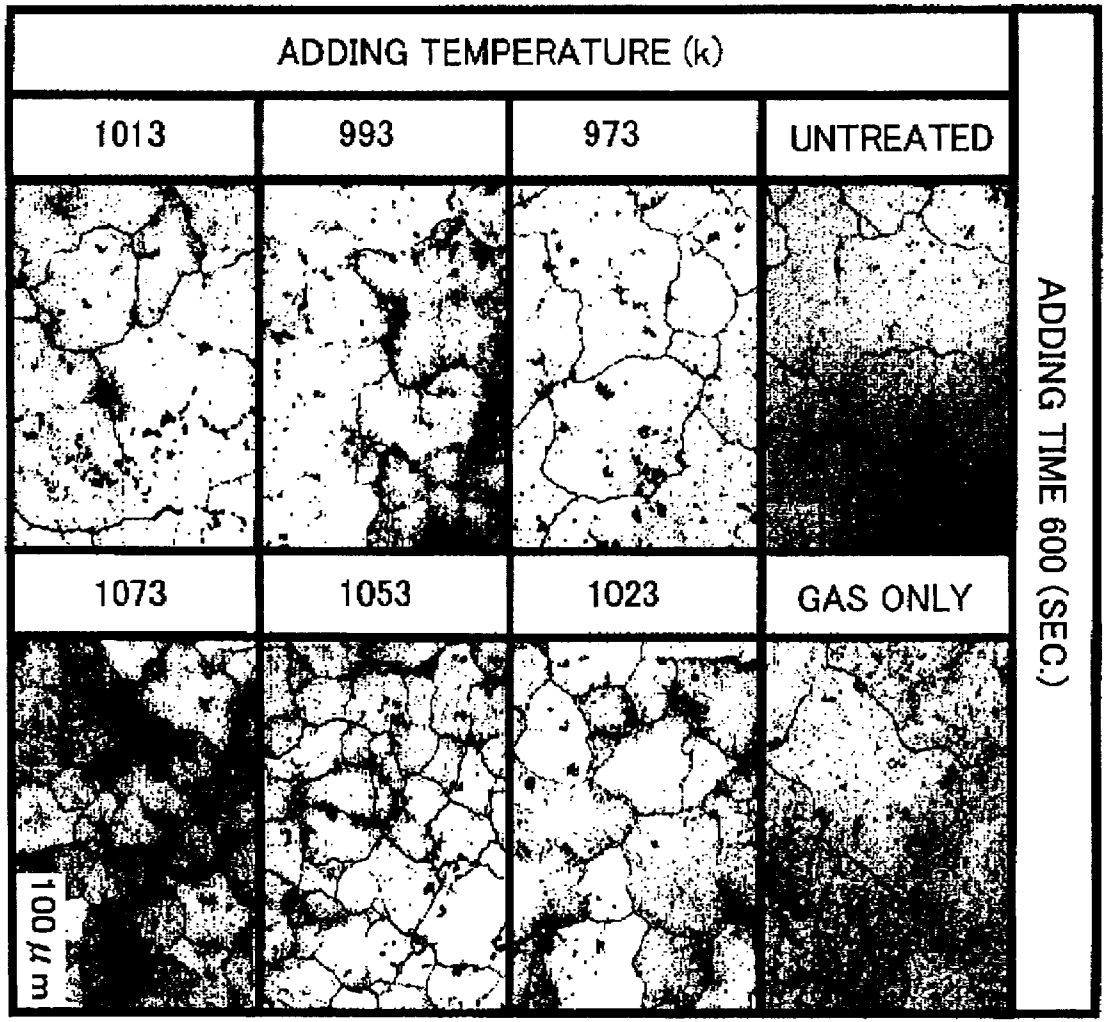
FIG. 3 is an optical micrograph of the cast alloy structures obtained in Example 1 by adding 5-μm carbon powder at different temperatures.

FIG. 2 shows the relationship between the temperature at which 5-$\mu$m carbon powder was added and the average grain size of the cast alloy structure, when the carbon powder was added for 600 seconds, and FIG. 3 is an optical micrograph of the cast alloy structure. FIG. 2 shows that the average grain size was around 138 $\mu$m in the case of untreated alloy and that a refinement effect was observed when the temperature at addition was at least 1000 K. Grain refinement was particularly pronounced when the temperature at addition was 1023 K or above, and more so at 1053 K or above, with grains being refined to 70 $\mu$m or below. This marked effect can also be seen in the cast structure micrograph of FIG. 3.

Figure 4:
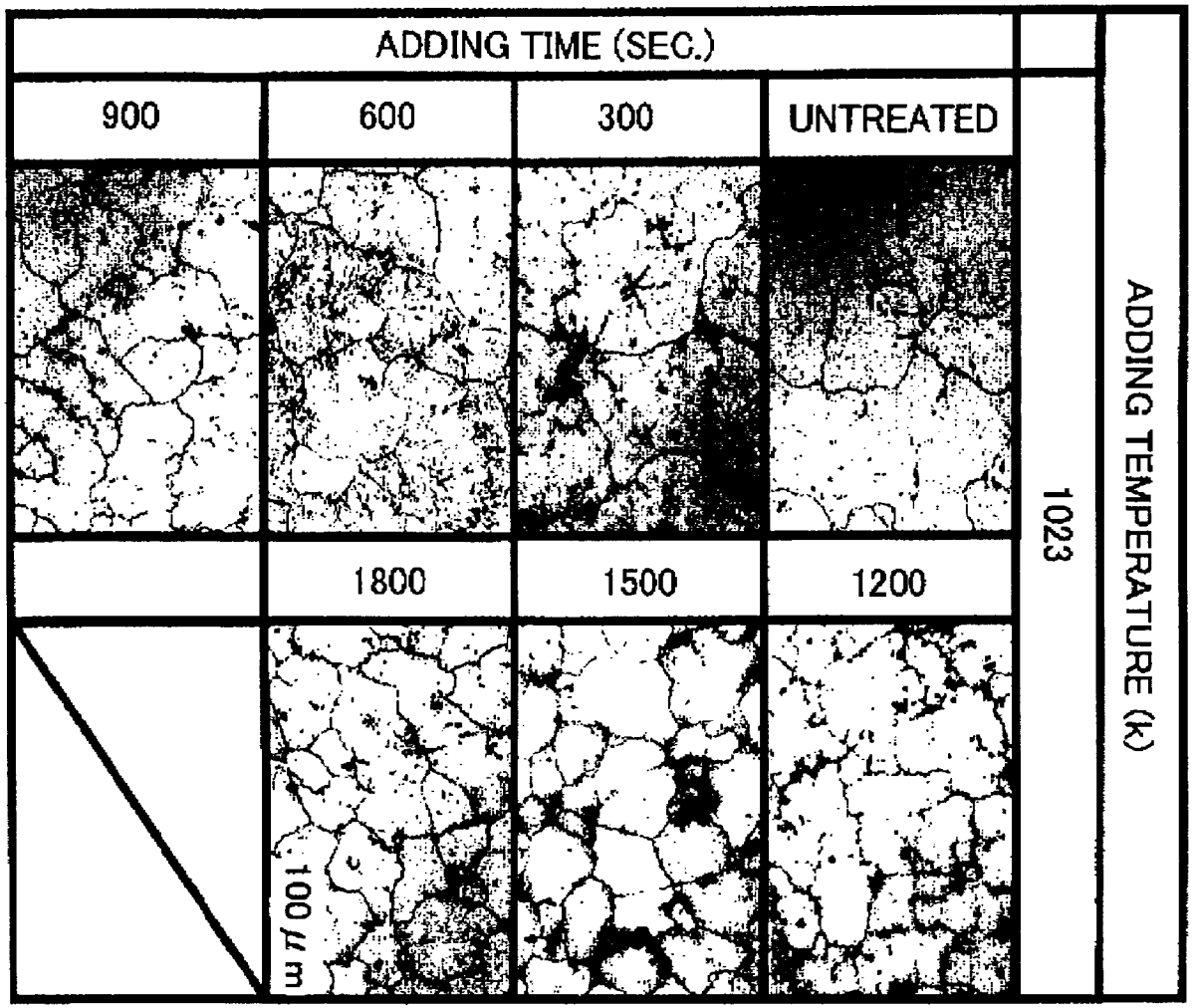
FIG. 4 is an optical micrograph of the cast alloy structures obtained in Example 1 by adding 5-μm carbon powder for different times at a temperature of 1023 K.

Next, castings were produced by maintaining the Mg alloy melt in the melting pot at 1023 K while adding 5-$\mu$m carbon powder for 300, 600, 900, 1200, 1500 and 1800 seconds, respectively, and the average grain size in each case was measured. FIG. 4 shows the results. From FIG. 4, it can be seen that a refinement effect was observed when the adding time was at least 600 seconds, and a pronounced refinement effect was observed when the adding time was 900 seconds or more.

Figure 5:
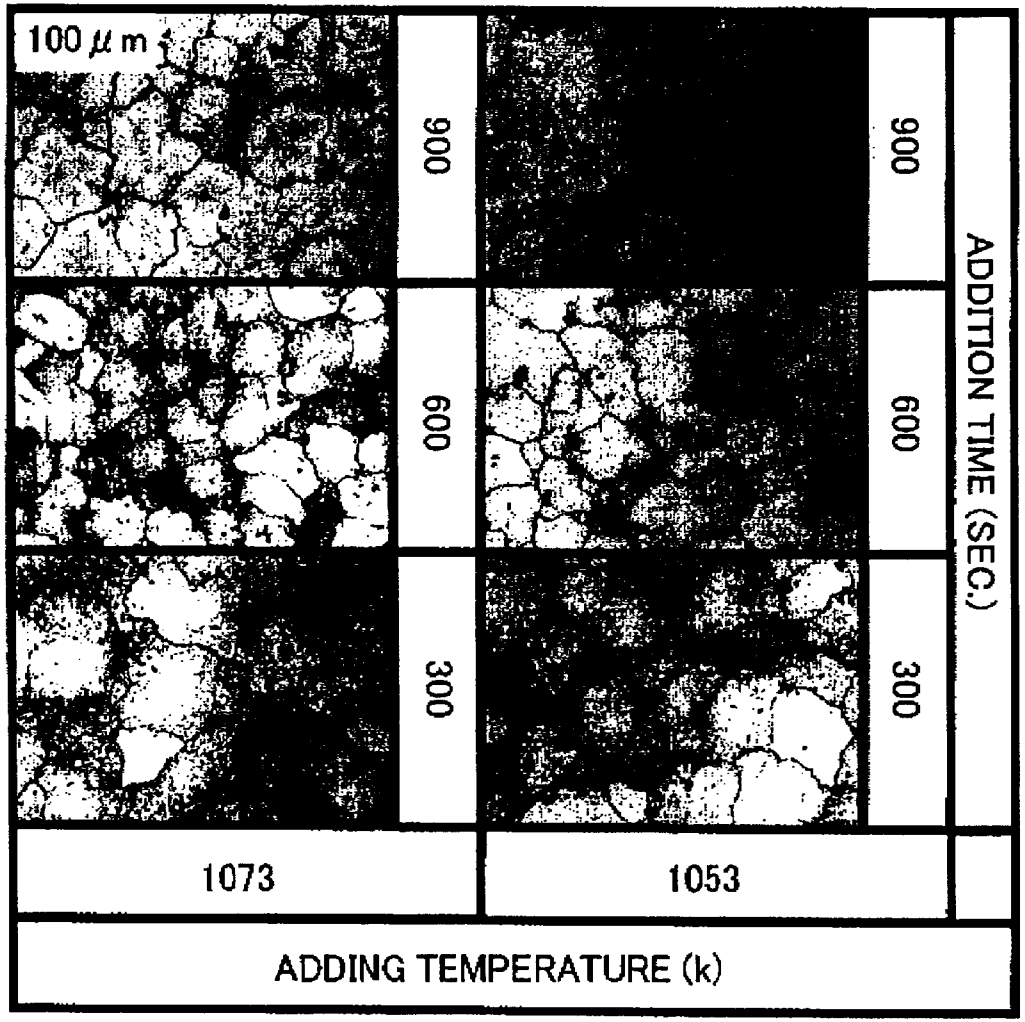
FIG. 5 is an optical micrograph of the cast alloy structures obtained in Example 1 by adding 5-μm carbon powder for different times at temperatures of 1053 K and 1073 K.

Finally, 5-$\mu$m carbon powder was added for 300, 600 and 900 seconds in respect of Mg alloy melts in the melting pot being maintained at 1053 K and 1073 K, and the average grain size in each case was measured. The results are shown in FIG. 5, from which it can be seen that a refinement effect was observed even at an adding time of 300 seconds, and a particularly pronounced refinement effect was observed when s an adding time of 600 seconds or more was used.

EXAMPLE 2

Figure 6:
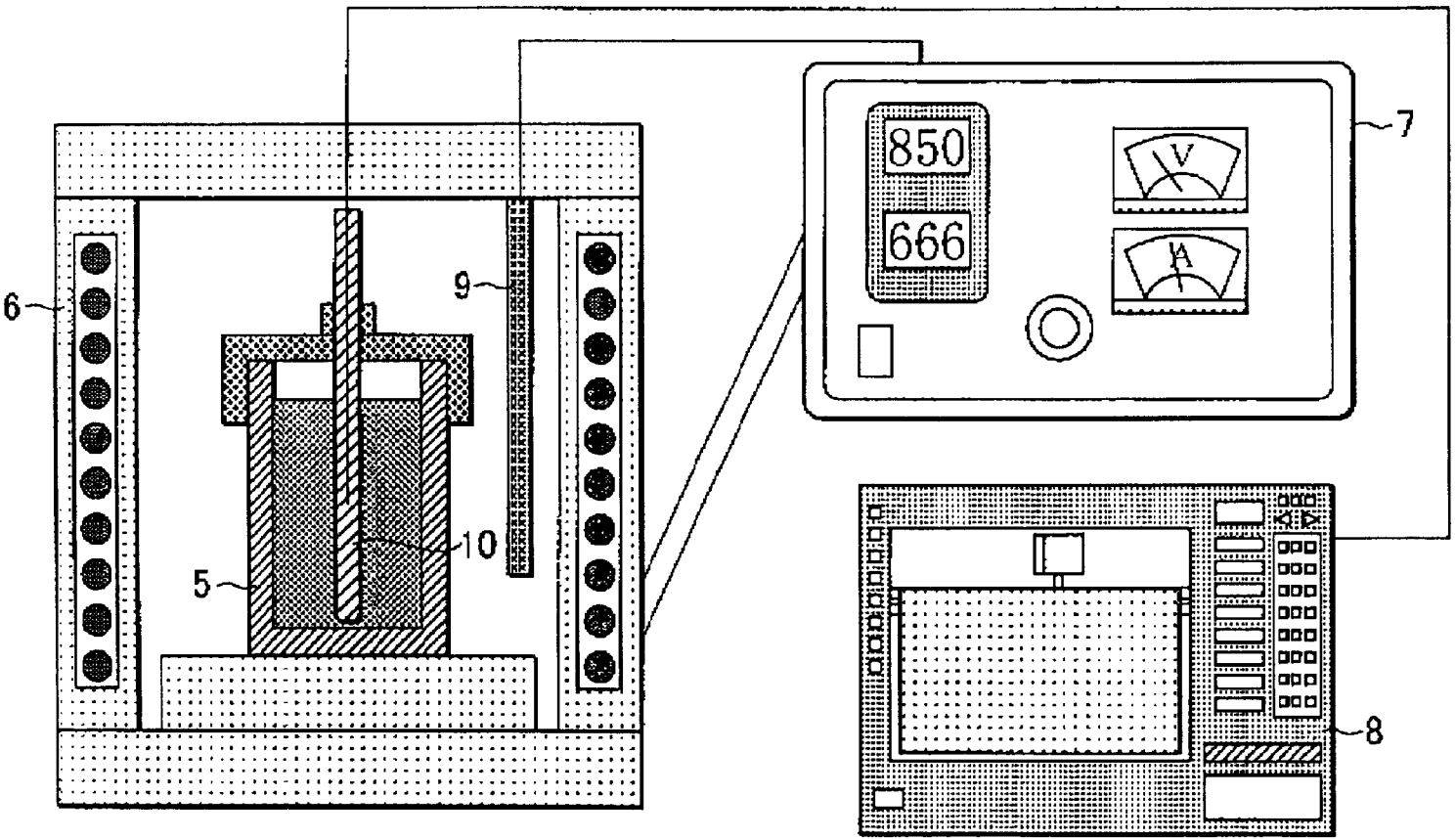
FIG. 6 shows an apparatus used in Example 2 of the present invention.
Figure 7:
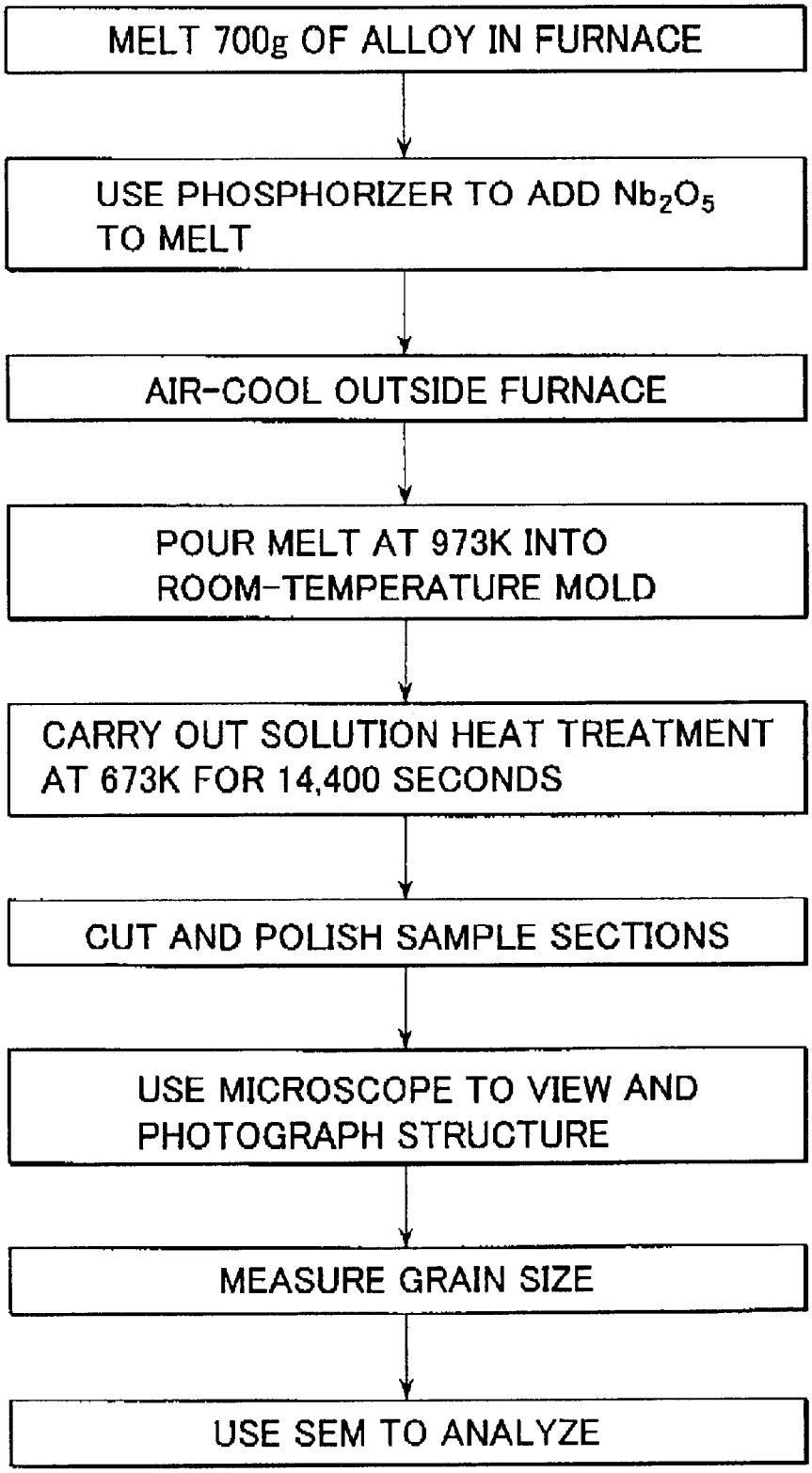
FIG. 7 is a flow chart of the process of Example 2.

A stainless-steel melting pot was fabricated, as in Example 1. The same material was also used to fabricate a chamber to prevent combustion, and a phosphorizer for adding $Nb_2O_5$, As in Example 1, AZ91E magnesium alloy was used, and the apparatus of FIG. 6 was used to perform casting by the procedure listed in FIG. 7. The cast grains thus obtained were measured and analyzed using a scanning electron microscope (SEM). In FIG. 6, reference numeral 5 denotes the melting pot, numeral 6 an electric furnace, numeral 7 a temperature controller, numeral 8 a pen recorder, numeral 9 a thermocouple used to measure the temperature inside the furnace, and numeral 10 a thermocouple used to measure the temperature of the melt in the melting pot.

First, in order to investigate the effect that the temperature has on the Al—Mn compound-spheroidizing effect of $Nb_2O_5$, the amount of $Nb_2O_5$ added (0.5% by weight) was kept the same while just the temperature of the melt was varied. Further, the alloy melt was sprayed with a mixed gas of $CO_2$ gas and $SF_6$ gas for about 900 seconds, with the $CO_2$ gas used as a carbon source Specifically, using the phosphorizer, tabletized $Nb_2O_5$ was added in an amount of 0.5% by weight of the melt amount, in respect of melts maintained at each of the temperatures 993, 1013, 1055 and 1073 K. After the completion of the reaction in each case, the alloy was removed from the furnace and allowed to cool in air. At 973 K, the alloy was poured into molds (at room temperature) to form round bars 20 mm in diameter and 100 mm in height. For comparison, an alloy ingot was also melted and cast. An optical microscope was used to measure the average size of the cast alloy grains.

Figure 8:
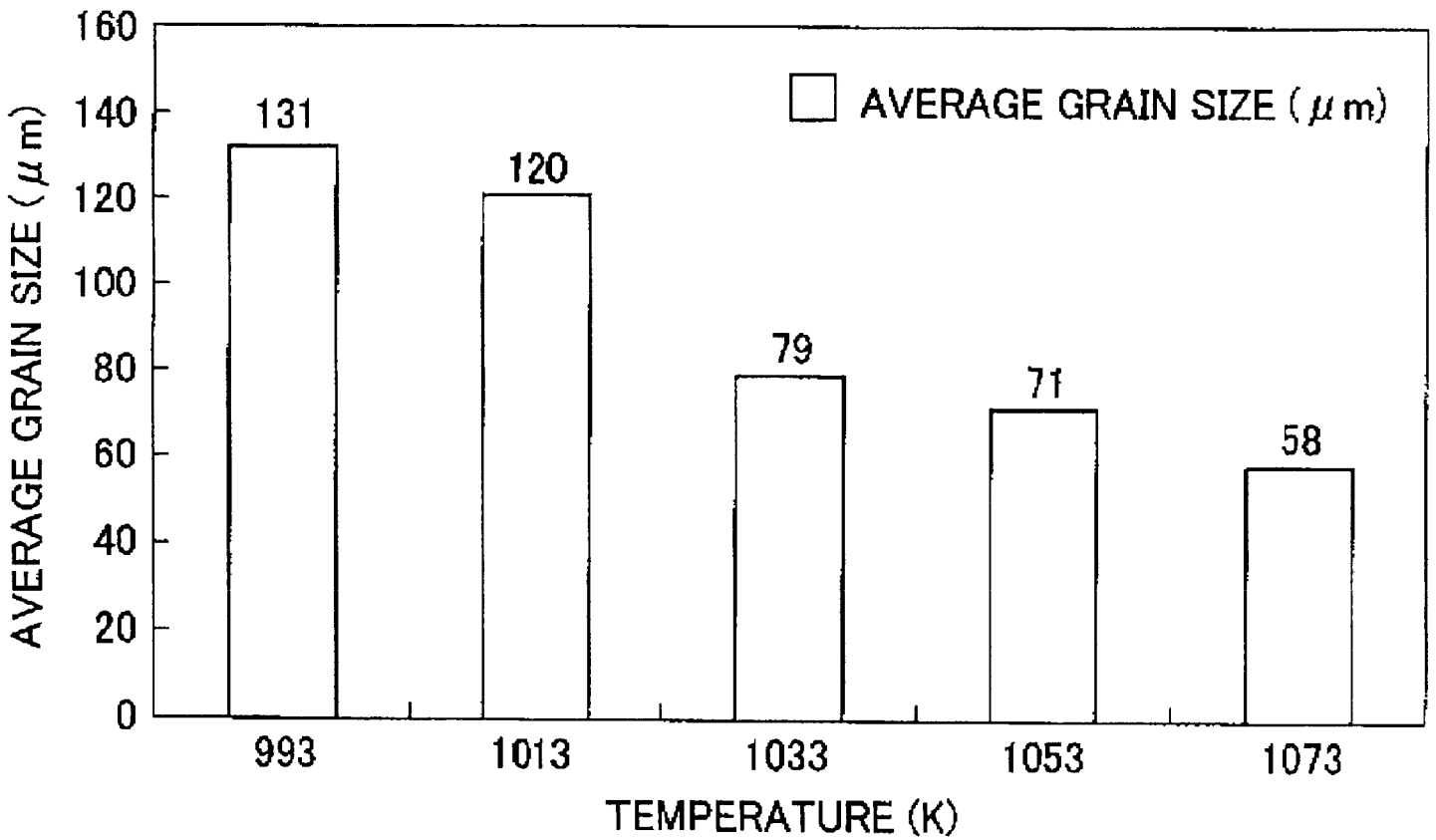
FIG. 8 is a graph showing the relationship in Example 2 between the temperature, at which $Nb_2O_5$ is added, and the effect on the average grain size.
Figure 9:
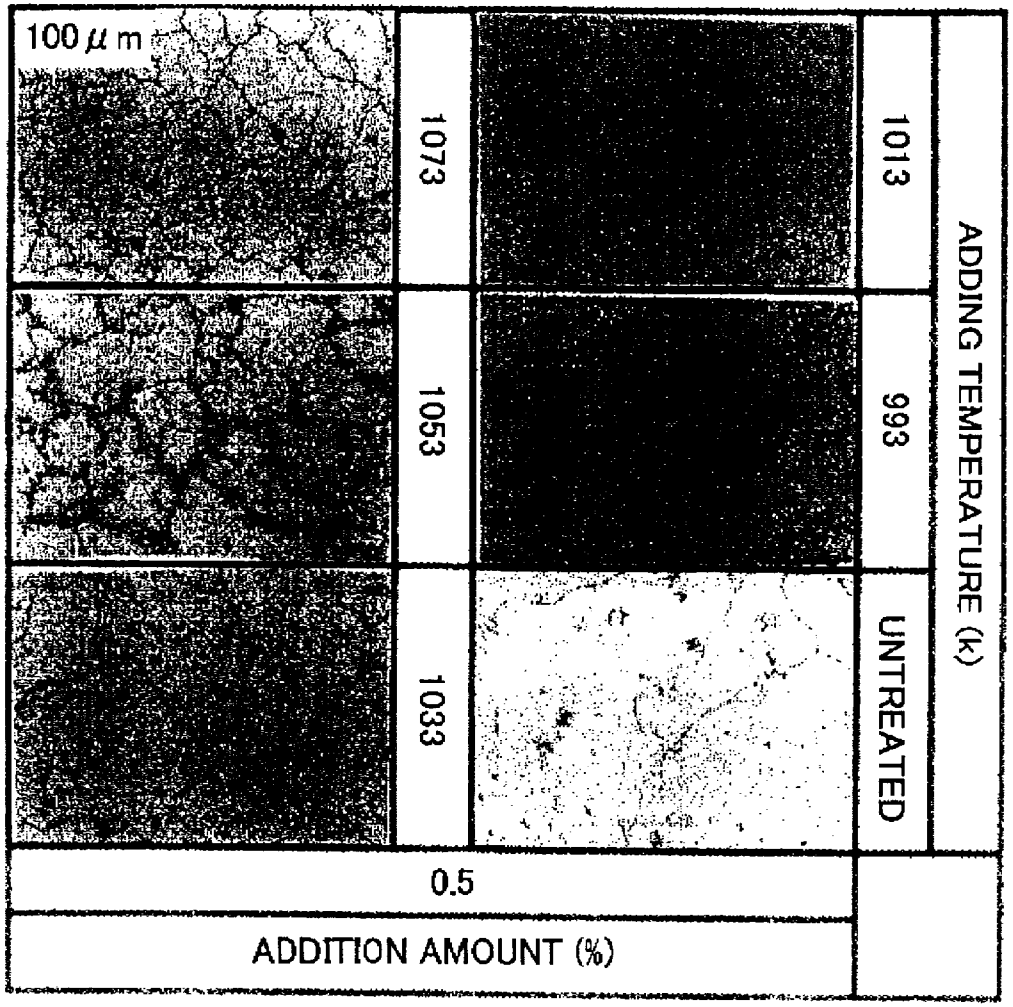
FIG. 9 is an optical micrograph of the cast alloy structures obtained in Example 2 by adding $Nb_2O_5$ at different temperatures.

FIG. 8 is a graph showing the relationship between the temperature at which $Nb_2O_5$ is added and the effect on the average grain size. The cast alloy structures obtained by an optical microscope are shown in FIG. 9. The average grain size in the case of untreated material was 192 $\mu$m. As can be seen from FIG. 8, grains were finer than that in each case, and in the case of the temperatures 1033, 1055 and 1073 K, the grain refinement effect was particularly pronounced, with grains measuring 100 $\mu$m or smaller. That is, grain refinement shows a tendency to increase when the addition temperature is higher. A high refinement effect was observed when the mixed gas ($CO_2$+$SF_6$) used as the carbon source at higher temperatures that promoted the reduction reaction. Also, a high refinement effect was observed when the $Nb_2O_5$ was added at higher temperatures that promoted the reduction reaction, and spheroidization of the Al—Mn compound was markedly observed. As a result, 1033 K or more was found to be the advantageous temperature that could bring about a spheroidizing effect.

Next, alloys were cast in the same manner as mentioned above, with 0.1, 0.2, 0.5 and 1.0 wt % $Nb_2O_5$ added to melts maintained at each of the temperatures (1033, 1053 and 1073 K) at which the grain refinement effect and Al—Mn compound-spheroidizing effect were observed. The material was non-balancedly solidified to carry out the observation. Therefore, solution heat treatment at 673 K for 14400 seconds was carried out to dissolve eutectic crystals produced by the non-balanced solidification. The section method was used to measure average grain size by an optical microscope.

Figure 10:
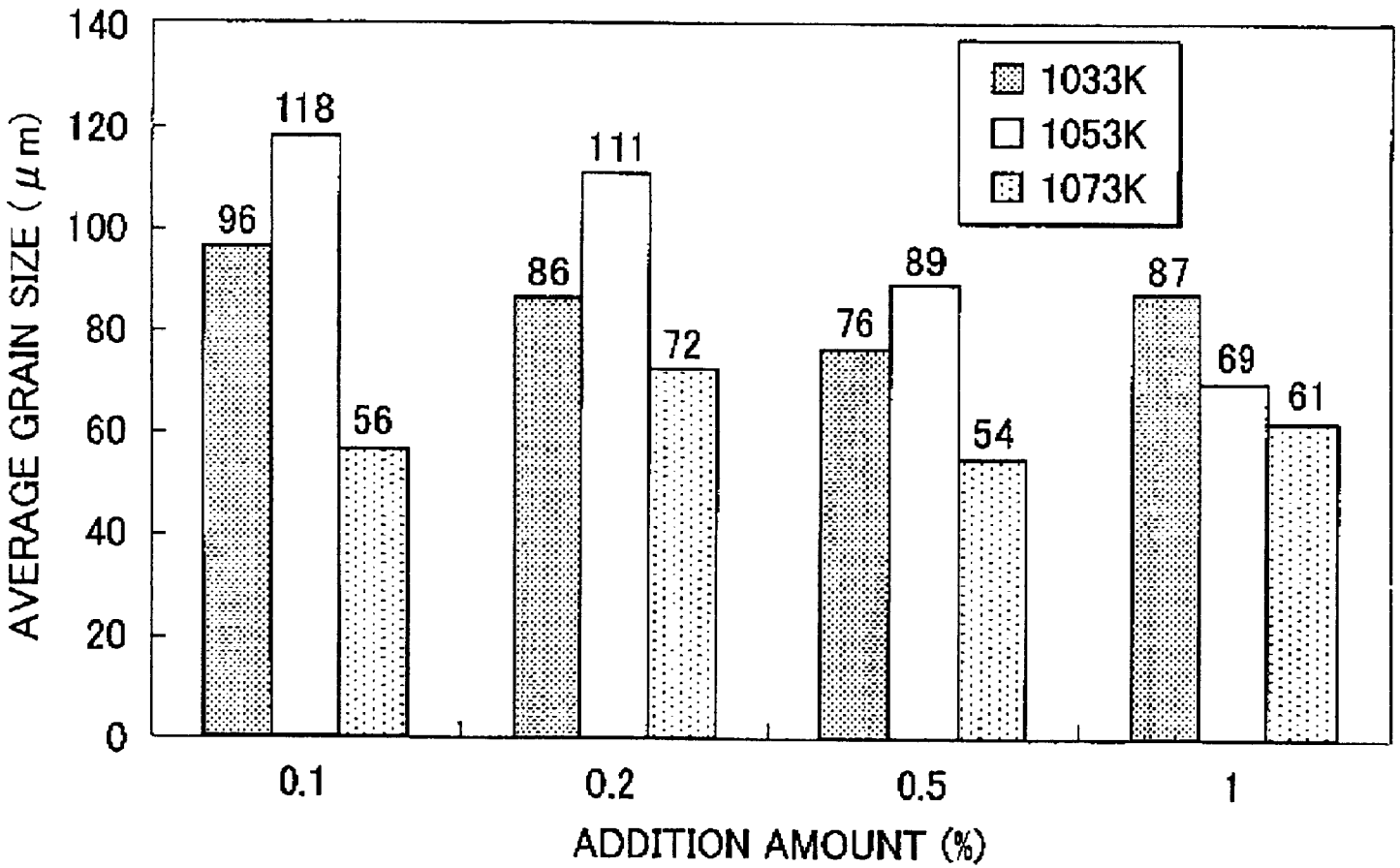
FIG. 10 is a graph showing the relationship in Example 2 between the amount of $Nb_2O_5$ added at 1033 K, 1053 K and 1073 K and the effect on the average grain size.
Figure 11:
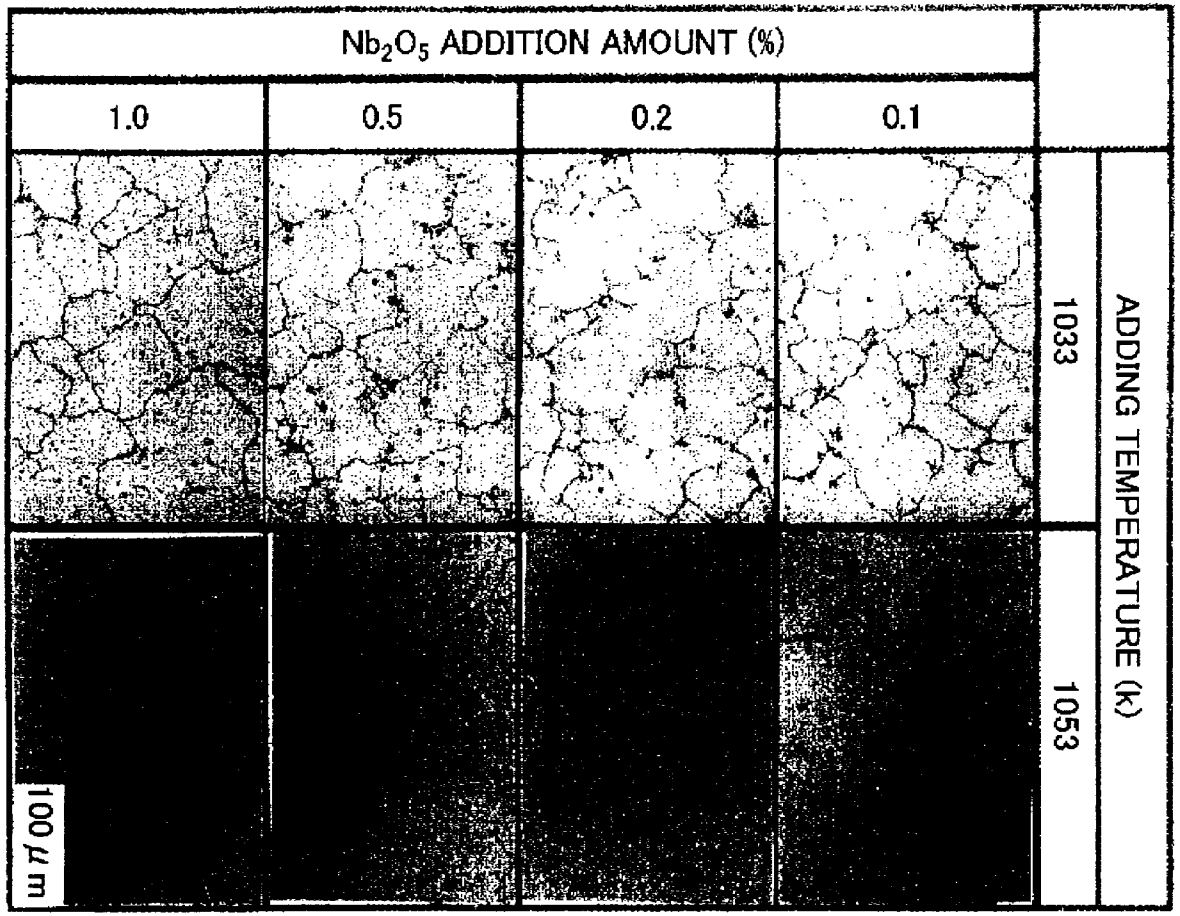
FIG. 11 is an optical micrograph of the cast alloy structures obtained in Example 2 by adding different amounts of $Nb_2O_5$ at temperatures of 1033 K and 1053 K.
Figure 12:
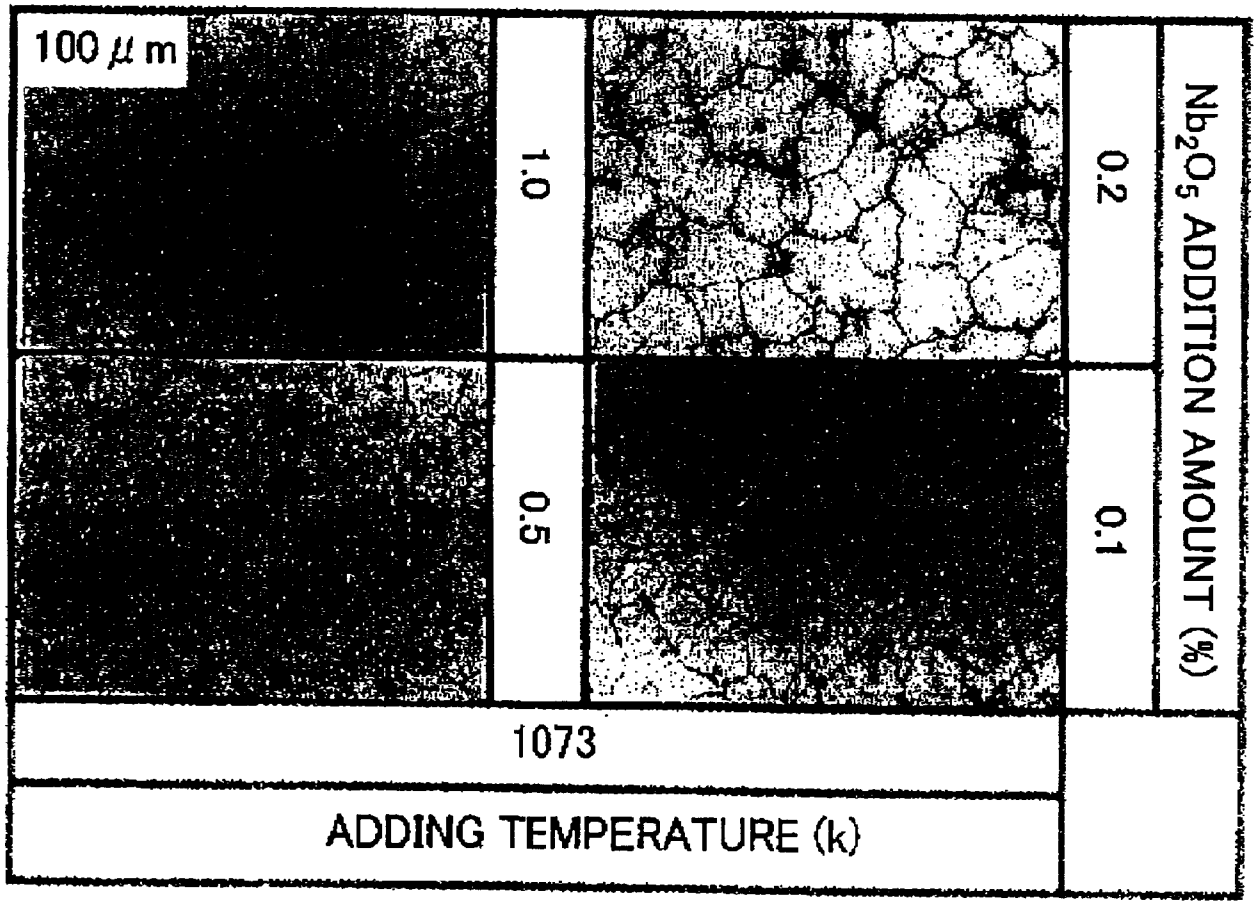
FIG. 12 is an optical micrograph of the cast alloy structures obtained in Example 2 by adding different amounts of $Nb_2O_5$ at a temperature of 1073 K.

FIG. 10 is a graph showing the relationship between the adding temperature and the amount of $Nb_2O_5$ that is added and has the effect on the average grain size when the temperature at the time of the addition is 1033 K, 1053 K and 1073 K, respectively FIGS. 11 and 12 are optical micrographs of the cast alloy structures thus obtained.

From FIG. 10, it can be seen that in the case of 1033 and 1073 K, the average grain size was refined, and s pronounced spheroidization of Al—Mn compounds was observed regardless of the amount of $Nb_2O_5$ added. At around 60 $\mu$m, grain refinement was particularly pronounced in the case of 1073 K.

The present invention has been described in the foregoing with reference to examples. However, it is to be understood that the invention is not limited to the above examples, and can be practiced using configurations modified to the extent that such changes do not depart from the scope of the appended claims.

The method of grain refining cast magnesium alloy in accordance with the present invention makes it possible to refine cast grains and improve mechanical properties, without producing dioxin or degrading corrosion resistance.

What is claimed is:

1. A method of grain refining cast magnesium alloy comprising:

adding a carbon source in combination with niobium pentoxide, $Nb_2O_5$, or vanadium pentoxide, $V_2O_5$, to a magnesium alloy melt containing aluminum and manganese, wherein the niobium pentoxide or vanadium pentoxide is added to the melt in an amount that is from 0.1 to 3% by weight of an amount of the melt at a temperature of from 993 to 1073 K.

2. The method according to claim 1, wherein the pure carbon powder is added to the melt by a carrier gas.

3. The method according to claim 2, wherein the carrier gas comprises at least one member selected from the group consisting of argon and helium.

4. The method according to claim 2, wherein the carrier gas comprises argon.

5. The method according to claim 2, wherein the carrier gas comprises helium.

6. The method according to claim 1, wherein the pure carbon powder is added to the melt in an amount is from 0.005 to 0.05% by weight of an amount of the melt at a temperature of from 993 to 1023 K.

7. The method according to claim 1, comprising adding the carbon source to the magnesium alloy melt.

8. The method according to claim 1, wherein the melt contains manganese.

9. The method according to claim 1, comprising adding the pure carbon powder to the magnesium alloy melt.

10. The method according to claim 1, wherein the melt contains aluminum.

11. The method according to claim 1, wherein the pure carbon powder has a particle size less than or equal to 5 $\mu$m.

12. The method according to claim 1, wherein the niobium pentoxide, $Nb_2O_5$, or vanadium pentoxide, $V_2O_5$, is added to the melt in at least one form selected from the group consisting of a powder, tablet and pellet.

13. The method according to claim 1, wherein the niobium pentoxide, $Nb_2O_5$, is added to the melt in at least one form selected from the group consisting of a powder, tablet and pellet.

14. The method according to claim 1, wherein the vanadium pentoxide, $V_2O_5$, is added to the melt in at least one form selected from the group consisting of a powder, tablet and pellet.

* * * * *